US012497739B1

(12) United States Patent
Frauenfelder, IV

(10) Patent No.: US 12,497,739 B1
(45) Date of Patent: Dec. 16, 2025

(54) GRAVEL SPREADER

(71) Applicant: Harry J. Frauenfelder, IV, Waldorf, MD (US)

(72) Inventor: Harry J. Frauenfelder, IV, Waldorf, MD (US)

( * ) Notice: Subject to any disclaimer, the term of this patent is extended or adjusted under 35 U.S.C. 154(b) by 0 days.

(21) Appl. No.: 19/300,781

(22) Filed: Aug. 15, 2025

(51) Int. Cl.
*E01C 19/20* (2006.01)

(52) U.S. Cl.
CPC .... *E01C 19/2005* (2013.01); *E01C 2019/207* (2013.01)

(58) Field of Classification Search
CPC ..... E01C 19/2005; E01C 2019/207
USPC ..... 404/83, 101, 104–108, 118
See application file for complete search history.

(56) References Cited

U.S. PATENT DOCUMENTS 1,735,297 A 11/1929 Pardu
2,005,896 A * 6/1935 Hurt ..... E01C 19/2005 239/650
2,176,534 A * 10/1939 Loos ..... E01C 19/205 404/110
2,188,553 A * 1/1940 Lathrop ..... E01C 19/185 404/104
2,832,273 A * 4/1958 Calabrese ..... E01C 19/15 404/106
2,874,620 A * 2/1959 Mentes ..... E01C 19/15 404/110
3,756,509 A * 9/1973 Hamnes ..... E01C 19/202 239/678
4,096,654 A 6/1978 McLaughlin
4,329,081 A 5/1982 Buvik
4,655,297 A 4/1987 Bourgeois, Jr.
5,191,943 A 3/1993 Minor et al.
5,251,999 A * 10/1993 McCracken ..... E01C 23/06 404/110

(Continued)

FOREIGN PATENT DOCUMENTS

FR 2999665 A1 * 6/2014 ..... F04D 7/04
GB 175791 A * 3/1922 ..... E01C 19/2005

OTHER PUBLICATIONS

"HillTip IceStriker™ Self-loading Drop Spreader"; printed on Jun. 21, 2025 from https://www.hilltip.com/en/products/spreaders/self-loading-drop-spreader/.

(Continued)

*Primary Examiner* — Raymond W Addie
(74) *Attorney, Agent, or Firm* — Nath, Goldberg & Meyer; Jerald L. Meyer; Morgan D. Rosenberg

(57) ABSTRACT

The gravel spreader includes a hopper with a pair of longitudinally opposed sidewalls, a pair of laterally opposed sidewalls, an open upper end and an open lower end. A pair of longitudinally-extending runners are respectively mounted on lower ends of the pair of laterally opposed sidewalls. In use, the gravel spreader is transported to a site for spreading of gravel by being releasably carried by a bucket of a tractor or the like. The gravel spreader is placed on a ground surface of the site for the spreading of the gravel and the bucket of the tractor is disengaged from the gravel spreader. The hopper is at least partially filled with the gravel to be spread and the gravel spreader is pulled over the ground surface using the bucket of the tractor, with the pair of longitudinally-extending runners sliding on the ground surface.

21 Claims, 14 Drawing Sheets

(56) References Cited

U.S. PATENT DOCUMENTS

| | | | | |
|---|---|---|---|---|
| 5,484,229 | A * | 1/1996 | Reece | E01C 19/185 404/110 |
| 5,641,249 | A * | 6/1997 | McClelland | E02B 5/02 404/96 |
| 5,988,937 | A * | 11/1999 | Komoriya | E01C 21/00 404/90 |
| 6,183,159 | B1 * | 2/2001 | Hashimoto | E02F 5/226 404/90 |
| 6,422,490 | B1 * | 7/2002 | Truan | A01C 15/18 239/677 |
| 6,488,443 | B2 | 12/2002 | Garrity, Jr. | |
| 8,333,533 | B1 * | 12/2012 | Fiorina | E01C 19/4893 404/105 |
| 8,888,403 | B2 | 11/2014 | Atherton | |
| 10,584,464 | B2 | 3/2020 | Armstrong | |
| 2017/0275830 | A1 * | 9/2017 | Narsingh | E01C 19/02 |
| 2025/0003160 | A1 | 1/2025 | Pelletier | |

OTHER PUBLICATIONS

"Rapid Industries Gravel Spreader"; printed on Jun. 21, 2025 from https://rapid-paver.com/en/gravel-paver/.

"BCS Spreader"; printed on Jun. 21, 2025 from https://www.bcsamerica.com/product/spreader.

* cited by examiner

GRAVEL SPREADER

BACKGROUND

Field

The disclosure of the present patent application relates to the dispensing and spreading of loose material on a surface, and particularly to a gravel spreader for spreading gravel on a road or on the ground.

Description of Related Art

Devices for spreading gravel are commonly used for repairing roads, establishing gravel road surfaces, and distributing gravel on the shoulders of paved roads. Such devices commonly include a reservoir for holding a volume of gravel, a distributor for distributing the gravel on the road or ground, and either means for locomotion or a connector for a separate vehicle, such as a truck, tractor or the like. Devices for spreading gravel which are intended for connection to a separate vehicle typically make use of permanent or semi-permanent attachments requiring large amounts of effort and mechanical knowledge to attach or detach the device. This not only makes the device inconvenient to transport and store separate from the associated vehicle, but also limits the usage of the vehicle for other applications. A gravel spreading device which remains mechanically detached from the associated vehicle would alleviate these issues. Thus, a gravel spreader solving the aforementioned problems is desired.

SUMMARY

The gravel spreader includes a hopper with a pair of longitudinally opposed sidewalls, a pair of laterally opposed sidewalls, an open upper end and an open lower end. A pair of longitudinally-extending runners are respectively mounted on lower ends of the pair of laterally opposed sidewalls. In use, the gravel spreader is transported to a site for spreading of gravel by being releasably carried by a bucket of a tractor or the like. The gravel spreader is placed on a ground surface of the site for the spreading of the gravel and the bucket of the tractor is disengaged from the gravel spreader. The hopper is at least partially filled with the gravel to be spread and the gravel spreader is pulled over the ground surface using the bucket of the tractor, with the pair of longitudinally-extending runners sliding on the ground surface.

A crossbar may be mounted on, and extend between, respective first ends of the pair of longitudinally-extending runners. A lip may be mounted on the hopper adjacent the open lower end thereof. In use, the gravel spreader may be releasably carried by the bucket of the tractor with the bucket releasably contacting the crossbar and the lip adjacent the open lower end of the hopper. The gravel spreader may be pulled over the ground surface by contacting the crossbar with the bucket of the tractor to frictionally engage the crossbar with the bucket. A reinforcing bar, made from metal or the like, may be secured to an upper surface of the crossbar. Longitudinal movement of the bucket (under the driven movement of the tractor) pulls the gravel spreader.

A plurality of angled ribs may be mounted on inner faces of the pair of longitudinally opposed sidewalls of the hopper. The ribs direct the gravel during the filling of the hopper therewith toward the pair of laterally opposed sidewalls of the hopper in order to prevent the gravel from accumulating in the center of the hopper. This also applies to the stage of applying the gravel on the ground surface.

A cover may be provided for releasably covering the open upper end of the hopper. The cover may be pivotally secured to an upper edge of one of the longitudinally opposed sidewalls and have a plurality of slots formed therethrough. The slots of the cover may be defined by a plurality of angled slats. The gravel may be evenly distributed within the hopper during the filling thereof with the gravel by passage through the slots over the plurality of angled slats.

Additionally, a platform may be mounted on, and extend between, respective second ends of the pair of longitudinally-extending runners for carrying tools, supporting a user or the like. The first ends and second ends of each of the longitudinally-extending runners may be pivotable with respect to a central portion of the respective one of the longitudinally-extending runners, allowing the ends to be folded up during transport and/or storage of the gravel spreader.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
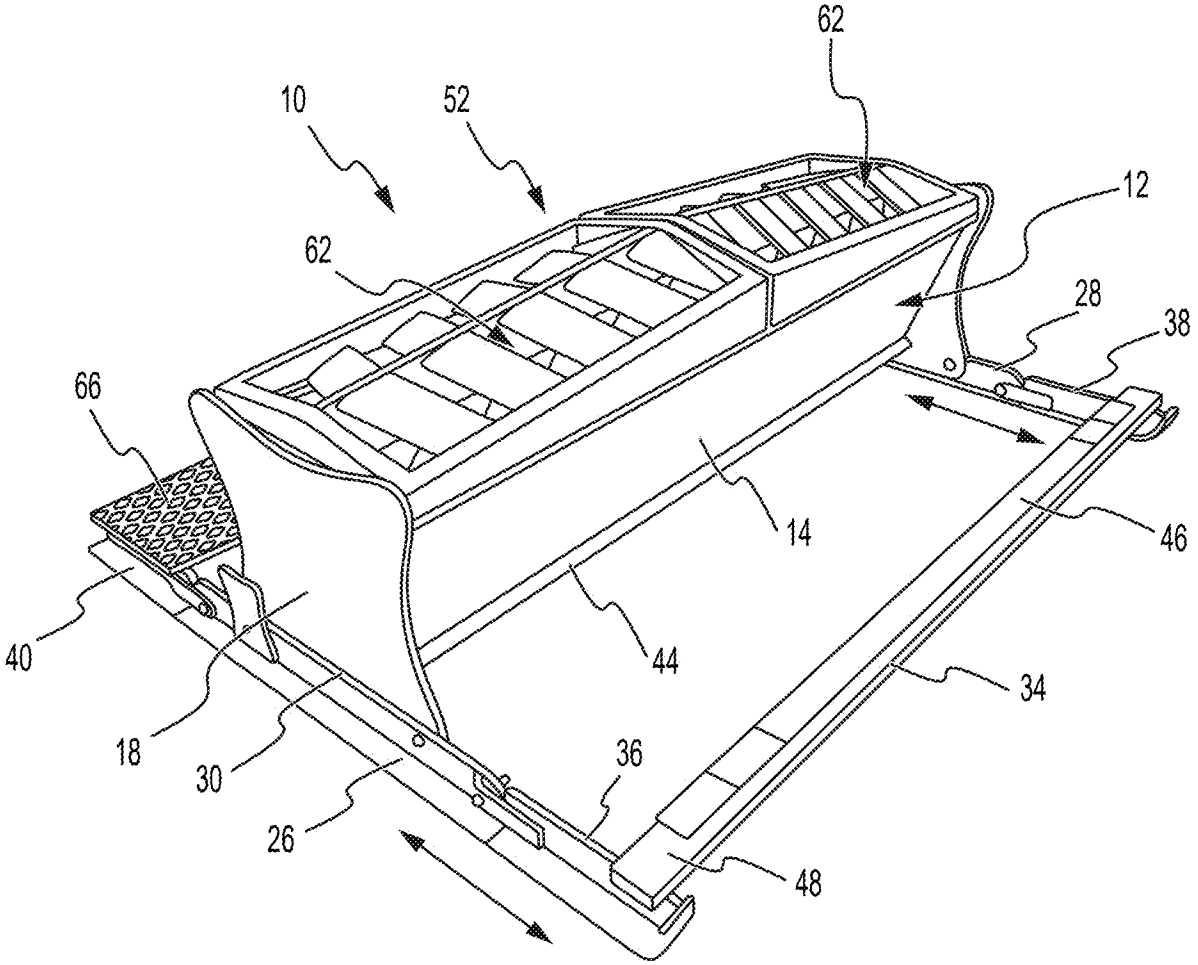
FIG. 1 is a perspective view of the gravel spreader.

As best seen in FIGS. 1-4, the gravel spreader 10 includes a hopper 12 with a pair of longitudinally opposed sidewalls 14, 16, a pair of laterally opposed sidewalls 18, 20, an open upper end 22 and an open lower end 24. A pair of longitudinally-extending runners 26, 28 are respectively mounted on lower ends 30, 32 of the pair of laterally opposed sidewalls 18, 20. It should be understood that the overall shape and relative dimensions of the hopper 12 are shown for exemplary purposes only and may be varied. Similarly, it should be understood that the relative dimensions, positioning and overall shape of the longitudinally-extending runners 26, 28 are also shown for exemplary purposes only and may be varied.

Figure 2:
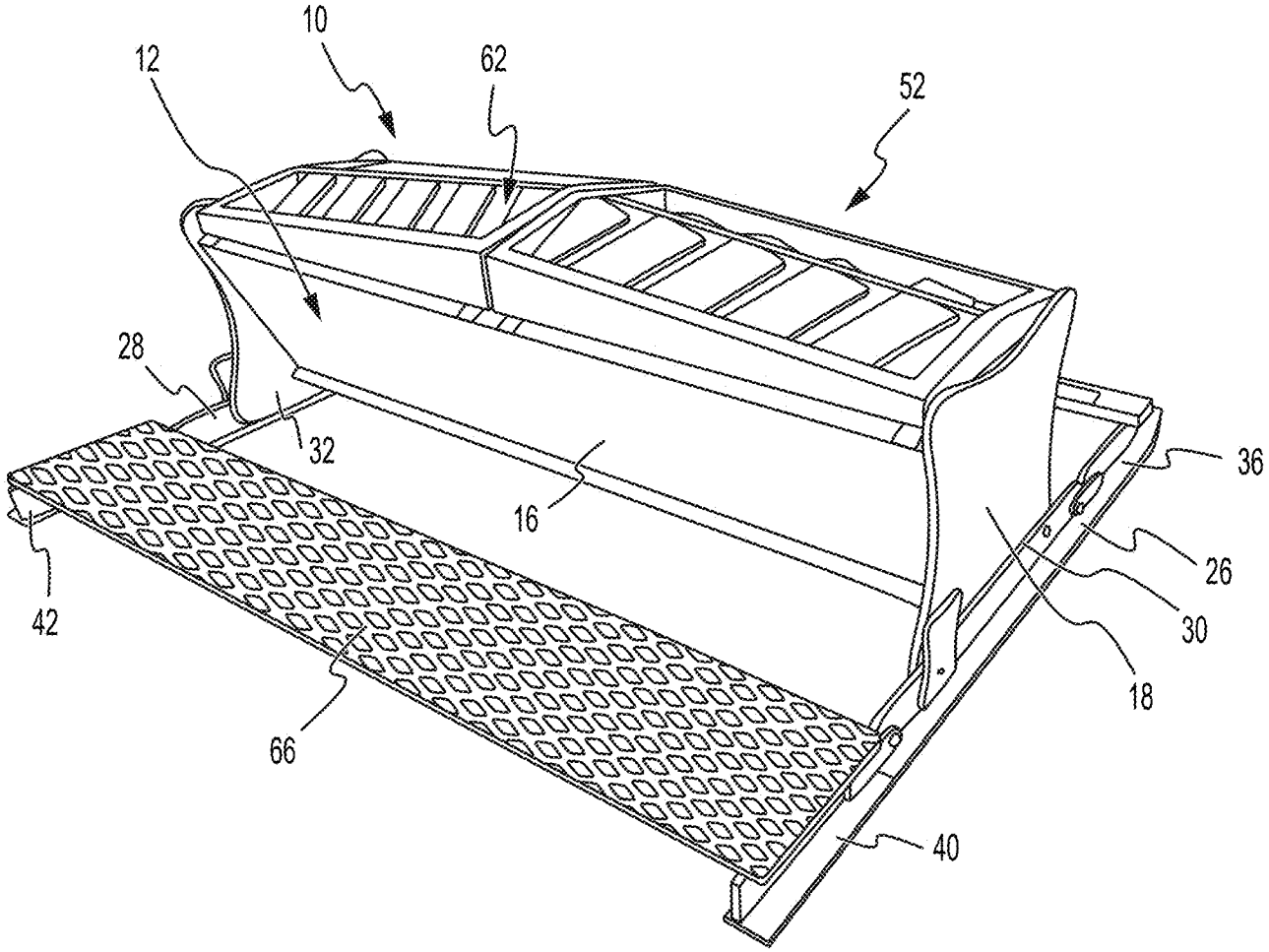
FIG. 2 is another perspective view of the gravel spreader.

In the non-limiting example of FIGS. 1 and 2, first ends 36, 38 of the pair of longitudinally-extending runners 26, 28, respectively, are shown as having curved, ski-like contouring, and the second ends 40, 42 of the pair of longitudinally-extending runners 26, 28, respectively, are shown as having flat or blunt edges. It should be understood that ends 36, 38, 40, 42 may have any suitable contouring. Further, for purposes of manufacturing, as a non-limiting example, the longitudinally-extending runners 26, 28 may be manufactured each having two opposed blunt or flat ends. This would allow the gravel spreader 10 to initially be manufactured symmetrically, with hopper 12 also initially being manufactured symmetrically. The curved, ski-like end portions of first ends 36, 38 could then be added later in the manufacturing process.

Figure 8:
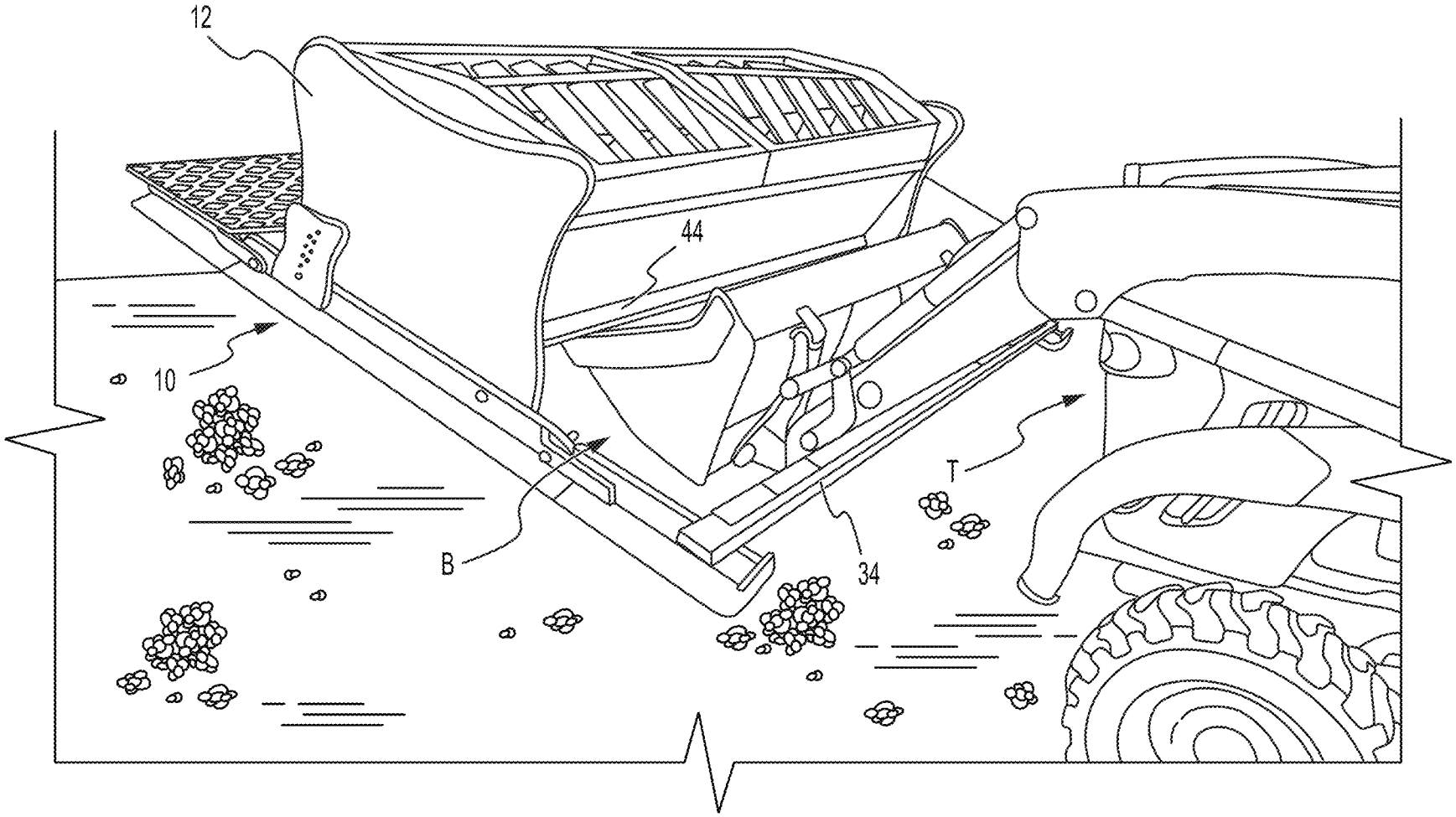
FIG. 8, FIG. 9, FIG. 10 and FIG. 11 are environmental perspective views showing the gravel spreader in use.
Figure 9:
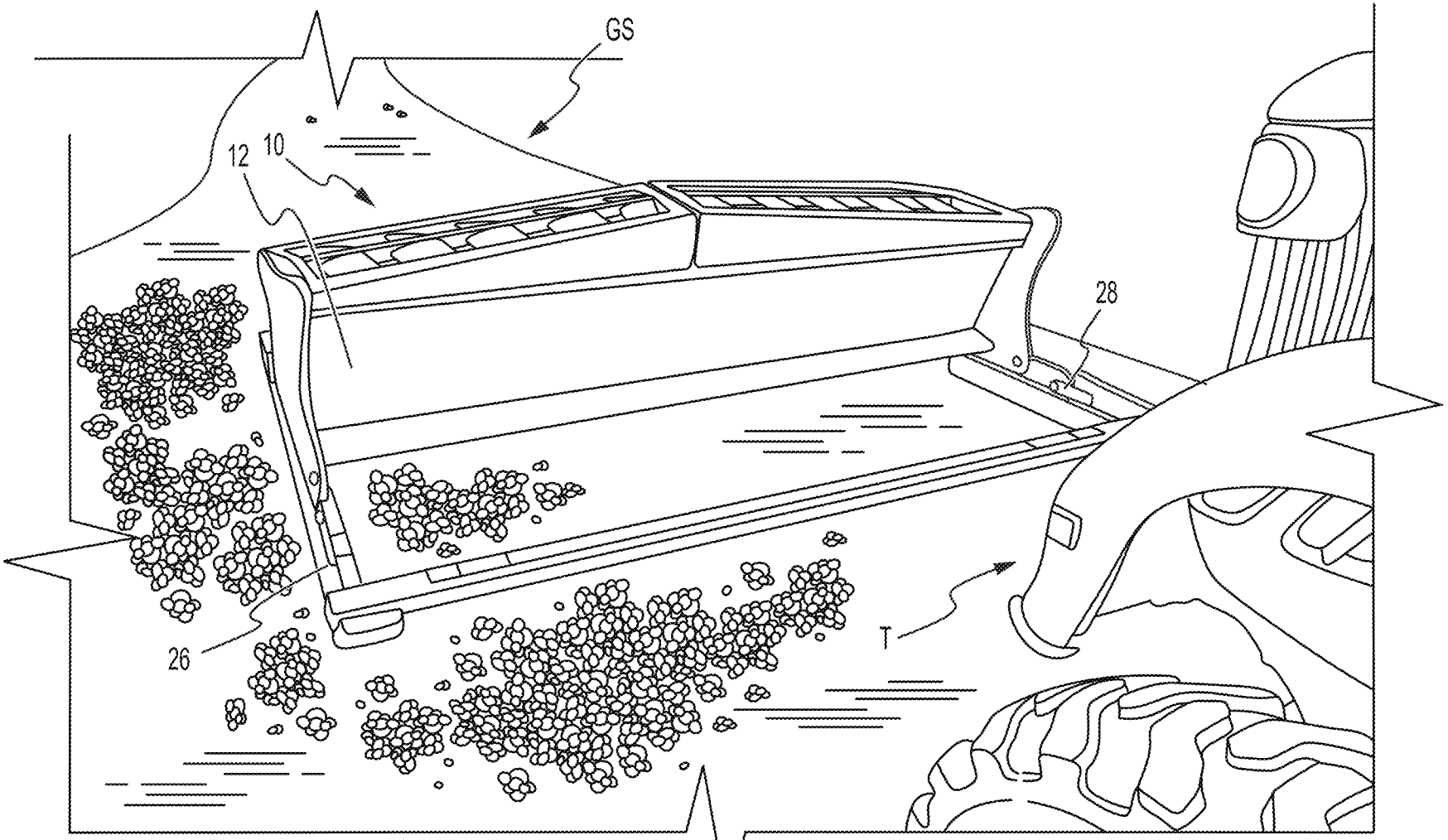
Figure 10:
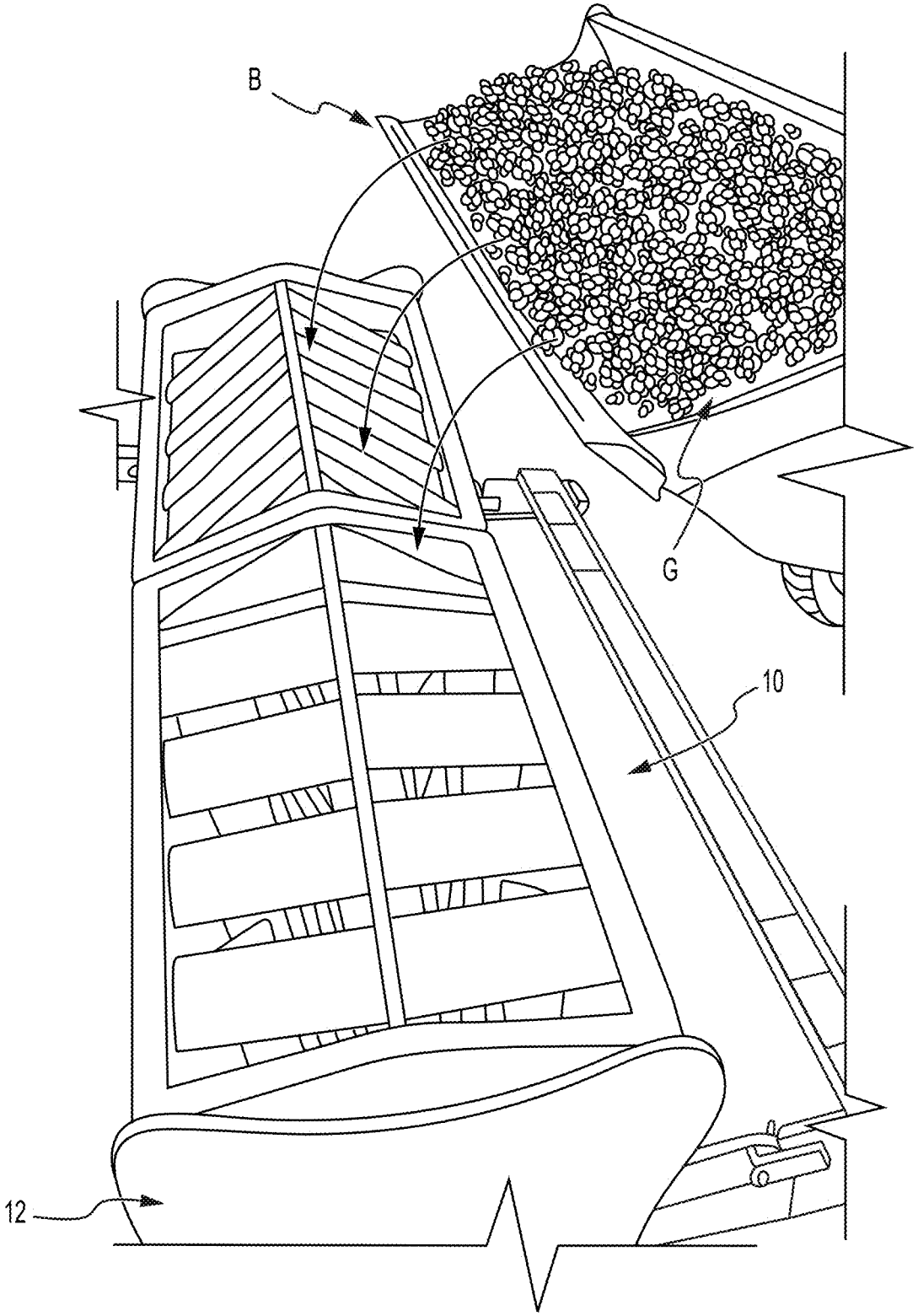
Figure 11:
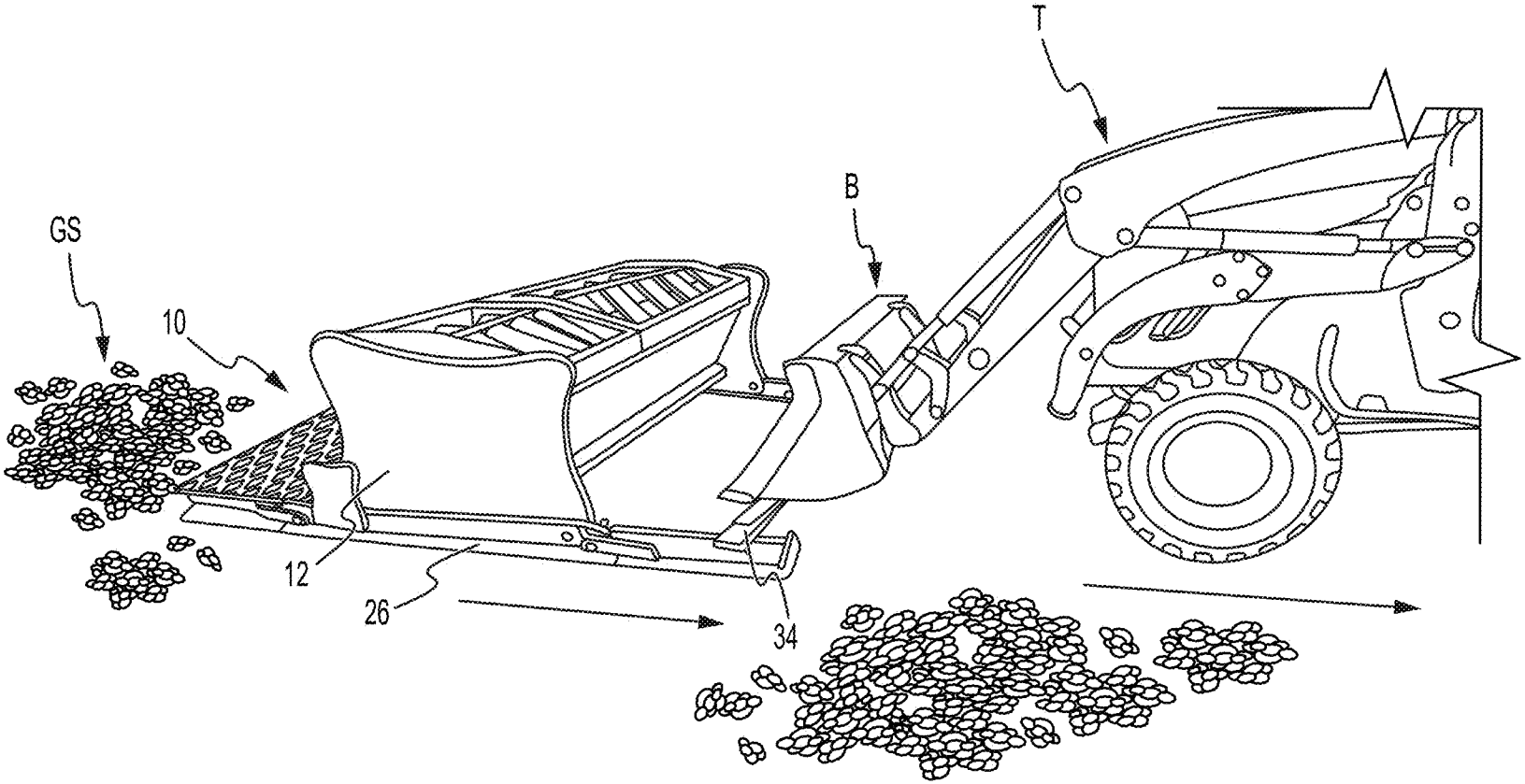

In use, as shown in FIG. 8, the gravel spreader 10 is transported to a site for spreading of gravel by being releasably carried by a bucket B of a tractor T or the like. It should be understood that bucket B and associated tractor T are shown for exemplary purposes only. As shown in FIG. 9, the gravel spreader 10 is placed on a ground surface GS of the site for the spreading of the gravel G and the bucket B of the tractor T is disengaged from the gravel spreader 10. As shown in FIG. 10, the hopper 12 is at least partially filled with the gravel G to be spread and, as shown in FIG. 11, the gravel spreader 10 is pulled over the ground surface GS using the bucket B of the tractor T, with the pair of longitudinally-extending runners 26, 28 sliding on the ground surface GS.

A crossbar 34 may be mounted on, and extend between, the respective first ends 36, 38 of the pair of longitudinally-extending runners 26, 28. A lip 44 may be mounted on the hopper 12 adjacent the open lower end 24, facing the crossbar 34. In use, as shown in FIG. 8, the gravel spreader 10 may be releasably carried by the bucket B of the tractor T with the bucket B releasably contacting the crossbar 34 and the lip 44 adjacent the open lower end 24 of the hopper 12. As shown in FIG. 11, the gravel spreader 10 may be pulled over the ground surface GS by contacting the crossbar 34 with the bucket B of the tractor T to frictionally engage the crossbar 34 with the bucket B. A reinforcing bar 46, made from metal or the like, may be secured to the upper surface 48 of the crossbar 34. Longitudinal movement of the bucket B (under the driven movement of the tractor T) pulls the gravel spreader 10 along the ground surface GS, and the gravel G empties from the hopper 12 onto the ground surface GS, under the force of gravity, through the open lower end 24 of hopper 12. It should be understood that the position of crossbar 34 may be adjusted in the longitudinal direction (as indicated by the arrows in FIG. 1), allowing the gravel spreader 10 to be used with tractors having a wide variety of different sized buckets. As a non-limiting example, crossbar 34 may be slidably mounted on the longitudinally-extending runners 26, 28 and may be releasably locked in place using removable pins, bolts or the like. Further, as shown in, for example, FIGS. 4 and 6B, indicia, in the form of guide lines, as a non-limiting example, may be formed, imprinted or otherwise marked on reinforcing bar 46, providing a guide for proper positioning of the bucket.

Figure 3:
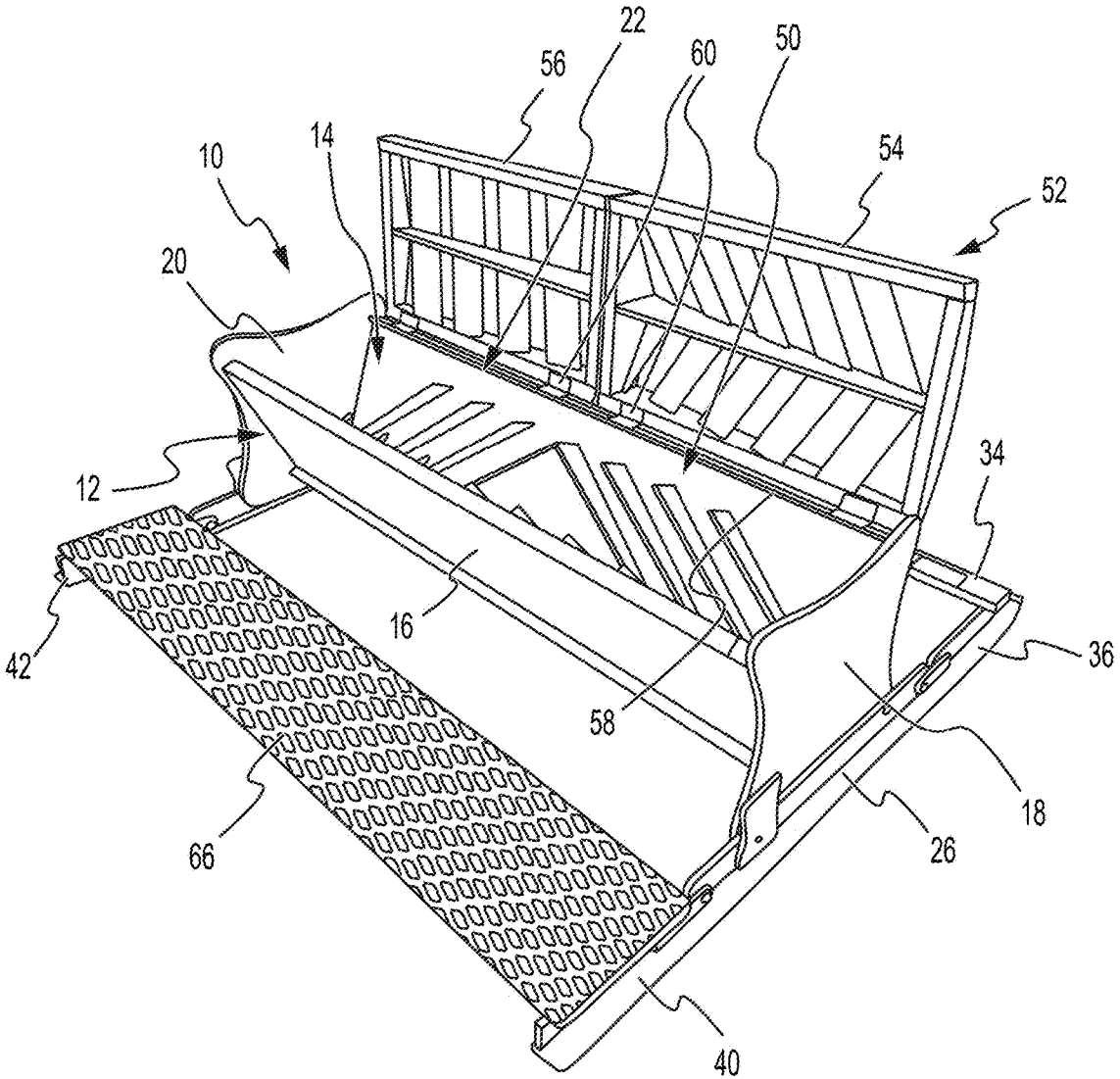
FIG. 3 is a perspective view of the gravel spreader, shown with a cover thereof open.
Figure 4:
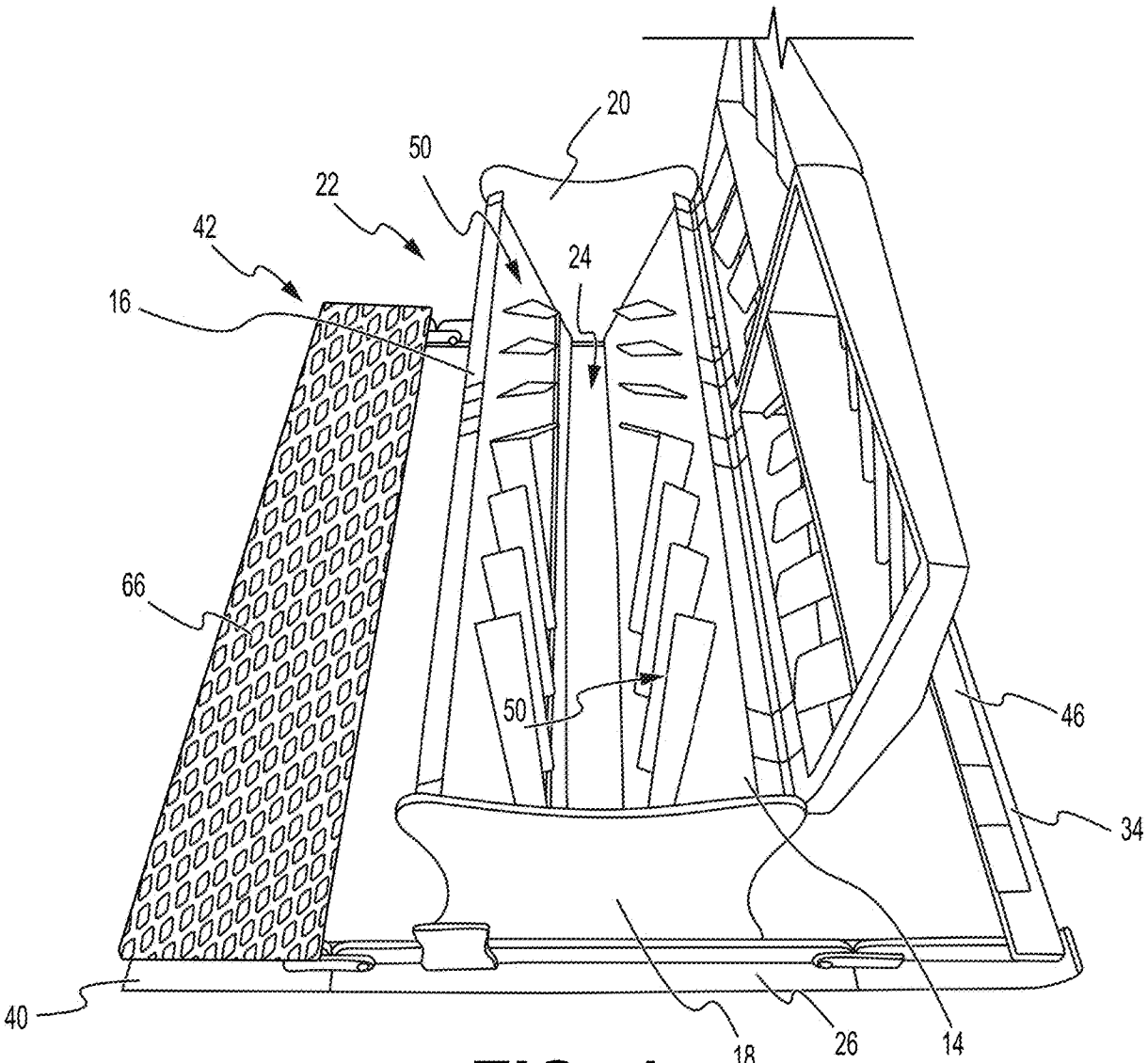
FIG. 4 is a perspective view of the gravel spreader, showing the interior of a hopper thereof.
Figure 12:
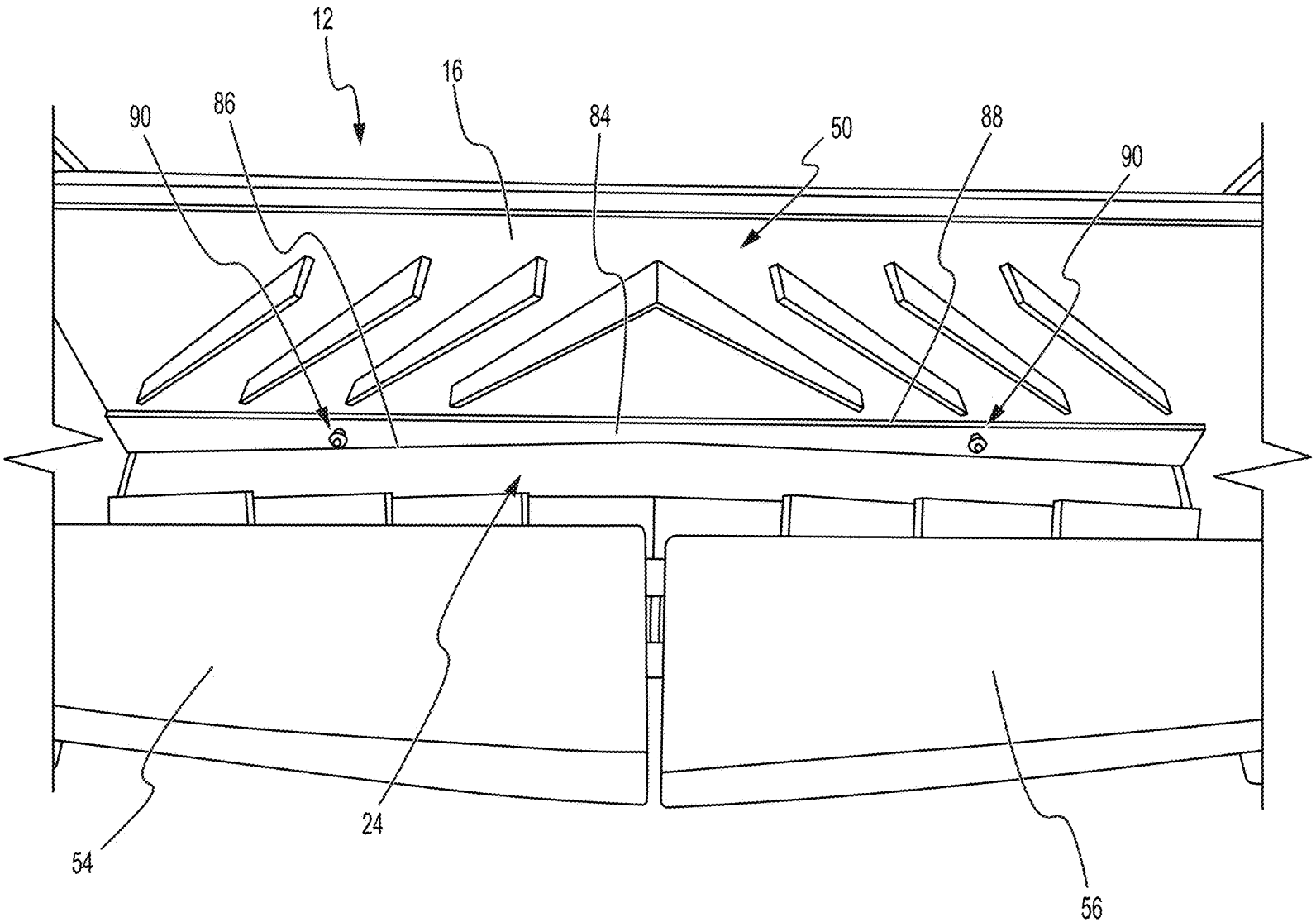
FIG. 12 is a partial perspective view of the gravel spreader.

As best shown in FIGS. 3 and 4, a plurality of angled ribs 50 may be mounted on inner faces of the pair of longitudinally opposed sidewalls 14, 16 of the hopper 12. The ribs 50 direct the gravel during the filling of the hopper 12 therewith toward the pair of laterally opposed sidewalls 18, 20 of the hopper 12 in order to prevent the gravel from accumulating in the center of the hopper 12. This also applies to the stage of applying the gravel on the ground surface. Further, as shown in FIG. 12, a blade 84 may be provided on the bottom edge of sidewall 16 of hopper 12 for smoothing the gravel being dispensed through the open lower end 24. As shown, a first edge 86 of blade 84 may be concavely contoured, as a non-limiting example, and the opposite second edge 88 may be flat. The blade 84 may be removed to reverse the orientations of first and second edges 86, 88, using a set of screws 90 or the like, depending on whether the user requires a flat or a curved grade for the dispensed gravel.

Figure 13:
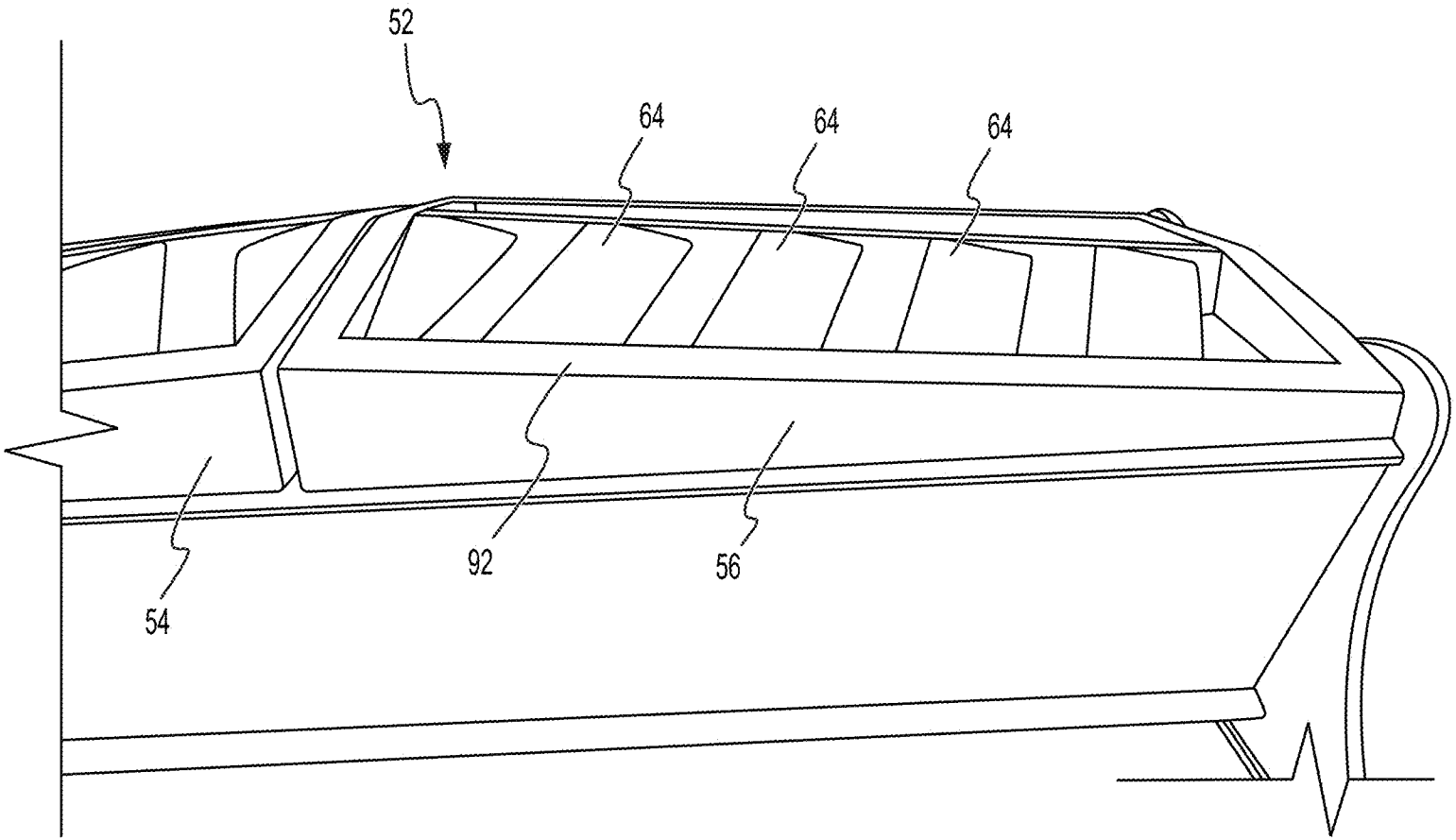
FIG. 13 is a partial perspective view of the gravel spreader.

A cover 52 may be provided for releasably covering the open upper end 22 of the hopper 12. The cover 52 may be pivotally secured to an upper edge 58 of one of the longitudinally opposed sidewalls 14, 16, by hinges 60 or the like, and have a plurality of slots 62 formed therethrough. As shown in, for example, FIG. 3, the cover 52 may be divided into two portions 54, 56, each of which can be opened or closed separate from the other. The slots 62 of the cover 52 may be defined by a plurality of angled slats 64. The gravel may be evenly distributed within the hopper 12 during the filling thereof with the gravel by passage through the slots 62 over the plurality of angled slats 64. As best seen in FIG. 13, the upper edges 92 of each of the portions of cover 52 may be sloped with respect to the horizontal. The slats 64 are not only arranged following this angle but, as shown, may also be angled with respect to both the vertical direction and the lateral direction.

Figure 5:
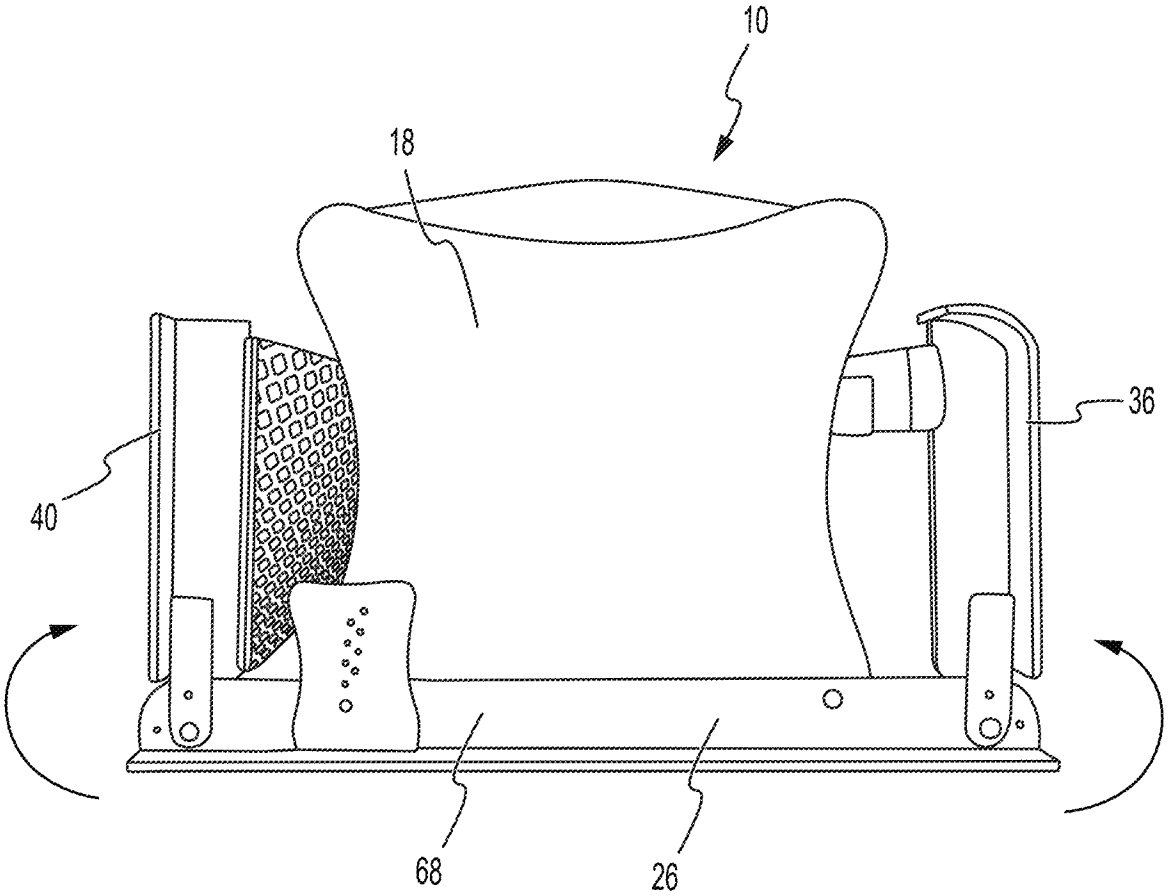
FIG. 5 is a side view of the gravel spreader, showing the gravel spreader in a collapsed configuration.

Additionally, as best shown in FIGS. 2-4, a platform 66 may be mounted on, and extend between, respective second ends 40, 42 of the pair of longitudinally-extending runners 26, 28 for carrying tools, supporting a user or the like. Although shown as a grate, it should be understood that platform 66 may have any suitable construction, including a solid construction, and may also have any suitable relative dimensions. Further, as shown in FIG. 5, the first ends 36, 38 and the second ends 40, 42 of each of the longitudinally-extending runners 26, 28, respectively, may be pivotable with respect to a central portion 68 of the respective one of the longitudinally-extending runners 26, 28, allowing the ends 36, 38, 40, 42 to be folded up during transport and/or storage of the gravel spreader 10. The ends 36, 38, 40, 42 may be locked in place with respect to their respective central portions by removable bolts, pins or the like. Additionally, as shown in FIG. 5, holes may be formed through both ends of each of the longitudinally-extending runners 26, 28. These holes may be used with corresponding holes (also seen in FIG. 5), via engagement with a pin or the like, to maintain the ends in either the folded or fully deployed position. Further, these holes may be also be used during transport on a trailer or flatbed truck, as non-limiting examples, to tie down the gravel spreader 10. It should be understood that the positioning, number and size of the holes is shown in FIG. 5 for exemplary purposes only and may be varied. As a non-limiting example, additional holes with larger diameters may be added closer to the ends.

Figure 6A:
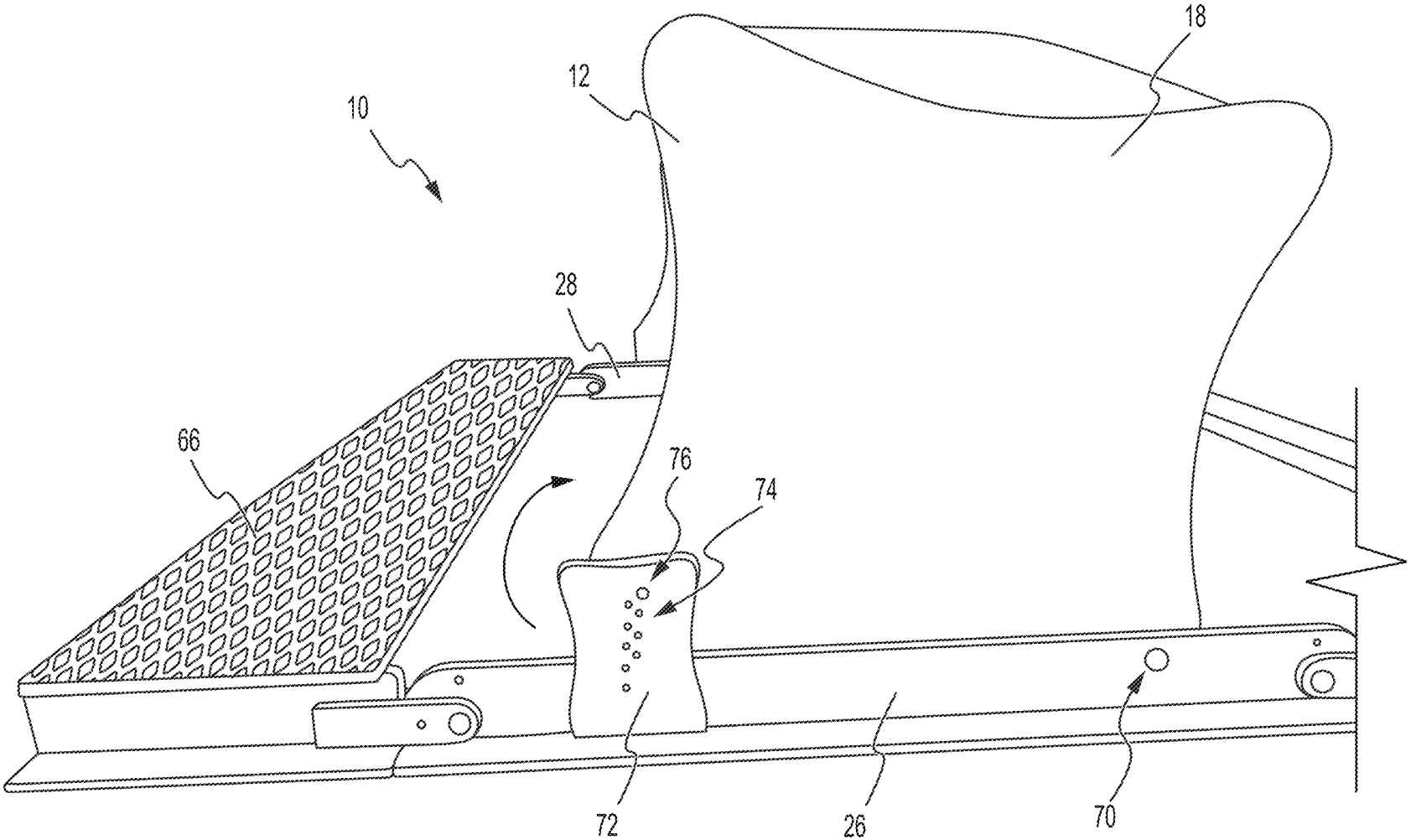
FIG. 6A is a side perspective view of the gravel spreader, showing the hopper in a pivoted position.

Additionally, as shown in FIG. 6A, the hopper 12 may be pivoted with respect to the longitudinally-extending runners 26, 28, rotating about pivot pins 70 or the like. It should be understood that the hopper 12 may be locked in place at a desired angle with respect to the longitudinally-extending runners 26, 28 using any suitable type of angular adjustment. In the non-limiting example of FIG. 6A, support plates 72 are mounted on the longitudinally-extending runners 26, 28, with each support plate 72 having a number of different openings 74 corresponding to a range of angular adjustments of hopper 12. When the hopper 12 is pivoted to the desired angle, a removable pin 76, bolt or the like can engage the appropriate opening 74 and a corresponding opening formed through the lower end of sidewall 18. A similar arrangement is provided for sidewall 20.

Figure 6B:
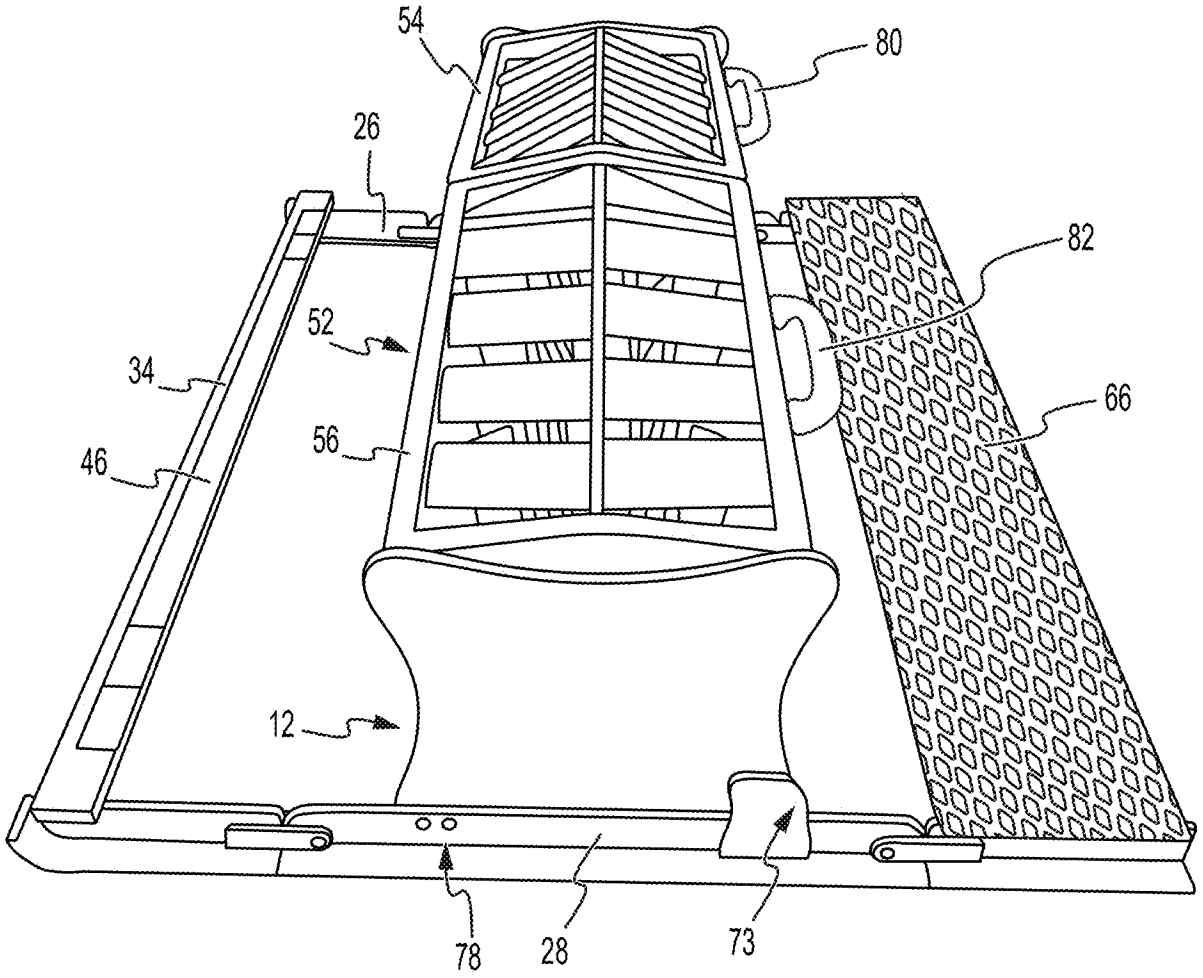
FIG. 6B is a perspective view of an alternative embodiment of the gravel spreader.
Figure 7:
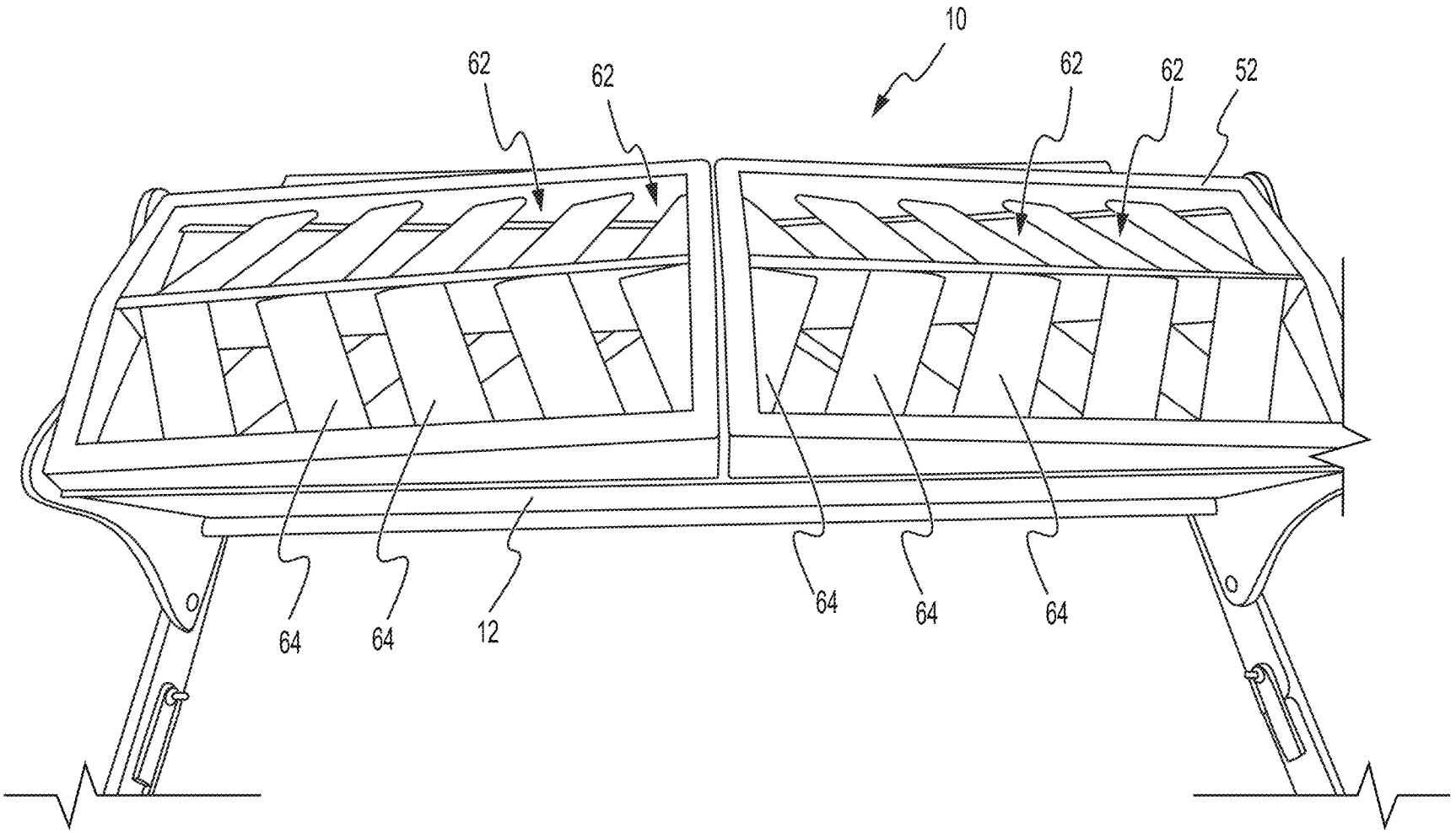
FIG. 7 is a perspective view of the gravel spreader.

It should be understood that support plate 72 is shown in FIG. 6A for exemplary purposes only and that the support plate 72 may have any suitable shape and relative dimensions. As a non-limiting example, in the alternative embodiment of FIG. 6B, the support plate 72 has been replaced with support plate 73, which serves the same purpose but has an alternative contour. Support plate 73 in FIG. 6B allows for the platform 66 to be raised by approximately two inches from its present height with respect to the longitudinally-extending runners 26, 28 and still be collapsed into the storage configuration of FIG. 5. Further, as shown in FIG. 6B, an additional removable pin or bolt 78 may be used to prevent the hopper 12 from being pivoted beyond its maximum safe height adjustment. Additionally, as shown, handles 80, 82 may be mounted on portions 54 and 56, respectively, of cover 52.

It is to be understood that the gravel spreader is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A gravel spreader, comprising:

a hopper having a pair of longitudinally opposed sidewalls, a pair of laterally opposed sidewalls, an open upper end and an open lower end;

a pair of longitudinally-extending runners respectively mounted on lower ends of the pair of laterally opposed sidewalls;

a crossbar mounted on, and extending between, respective first ends of the pair of longitudinally-extending runners;

a plurality of angled ribs mounted on inner faces of the pair of longitudinally opposed sidewalls of the hopper; and a cover for releasably covering the open upper end of the hopper, wherein the cover has a plurality of slots formed therethrough.

2. The gravel spreader as recited in claim 1, further comprising a platform mounted on, and extending between, respective second ends of the pair of longitudinally-extending runners.

3. The gravel spreader as recited in claim 1, wherein the first ends and second ends of each of the longitudinally-extending runners are pivotable with respect to a central portion of the respective one of the longitudinally-extending runners.

4. The gravel spreader as recited in claim 1, further comprising a reinforcing bar secured to an upper surface of the crossbar.

5. The gravel spreader as recited in claim 1, wherein the hopper is pivotable with respect to the pair of longitudinally-extending runners.

6. The gravel spreader as recited in claim 1, wherein the cover is pivotally secured to an upper edge of one of the longitudinally opposed sidewalls.

7. The gravel spreader as recited in claim 1, wherein a lip is mounted on the hopper adjacent the open lower end thereof.

8. The gravel spreader as recited in claim 1, wherein the slots of the cover are defined by a plurality of angled slats.

9. A gravel spreader, comprising:

a hopper having a pair of longitudinally opposed sidewalls, a pair of laterally opposed sidewalls, an open upper end and an open lower end;

a pair of longitudinally-extending runners respectively mounted on lower ends of the pair of laterally opposed sidewalls;

a plurality of angled ribs mounted on inner faces of the pair of longitudinally opposed sidewalls of the hopper; and a cover for releasably covering the open upper end of the hopper, wherein the cover has a plurality of slots formed therethrough.

10. The gravel spreader as recited in claim 9, further comprising a crossbar mounted on, and extending between, respective first ends of the pair of longitudinally-extending runners.

11. The gravel spreader as recited in claim 10, further comprising a reinforcing bar secured to an upper surface of the crossbar.

12. The gravel spreader as recited in claim 9, further comprising a platform mounted on, and extending between, respective second ends of the pair of longitudinally-extending runners.

13. The gravel spreader as recited in claim 9, wherein first and second ends of each of the longitudinally-extending runners are pivotable with respect to a central portion of the respective one of the longitudinally-extending runners.

14. The gravel spreader as recited in claim 9, wherein the cover is pivotally secured to an upper edge of one of the longitudinally opposed sidewalls.

15. The gravel spreader as recited in claim 9, wherein the slots of the cover are defined by a plurality of angled slats.

16. The gravel spreader as recited in claim 9, wherein the hopper is pivotable with respect to the pair of longitudinally-extending runners.

17. The gravel spreader as recited in claim 9, wherein a lip is mounted on the hopper adjacent the open lower end thereof.

18. A method of spreading gravel, comprising:

transporting a gravel spreader to a site for spreading of gravel, wherein the gravel spreader comprises a hopper having a pair of longitudinally opposed sidewalls, a pair of laterally opposed sidewalls, an open upper end and an open lower end, and wherein the gravel spreader further comprises a pair of longitudinally-extending runners respectively mounted on lower ends of the pair of laterally opposed sidewalls, the gravel spreader being releasably carried by a bucket of a tractor;

placing the gravel spreader on a ground surface of the site for the spreading of the gravel;

disengaging the bucket of the tractor from the gravel spreader;

at least partially filling the hopper with the gravel to be spread; and pulling the gravel spreader over the ground surface using the bucket of the tractor, the pair of longitudinally-extending runners sliding on the ground surface.

19. The method of spreading gravel as recited in claim 18, wherein a crossbar is mounted on, and extends between, respective ends of the pair of longitudinally-extending runners, the gravel spreader being releasably carried by the bucket of the tractor with the bucket releasably contacting the crossbar and the open lower end of the hopper.

20. The method of spreading gravel as recited in claim 18, wherein a plurality of angled ribs are mounted on inner faces of the pair of longitudinally opposed sidewalls of the hopper, the ribs directing the gravel during the filling of the hopper therewith toward the pair of laterally opposed sidewalls of the hopper.

21. The method of spreading gravel as recited in claim 18, wherein a cover releasably covers the open upper end of the hopper, wherein the cover has a plurality of slots formed therethrough, and wherein the slots of the cover are defined by a plurality of angled slats, the gravel being evenly distributed within the hopper during the filling thereof with the gravel by passage through the slots over the plurality of angled slats.

* * * * *